United States Patent [19]

Probost

[11] 4,231,133

[45] Nov. 4, 1980

[54] WET VACUUM MACHINE

[75] Inventor: Miroslav Probost, Pincourt, Canada

[73] Assignee: Deep Steam Extraction (1974) Ltd., Montreal, Canada

[21] Appl. No.: 21,340

[22] Filed: Mar. 19, 1979

[51] Int. Cl.[3] ..... A47L 9/22

[52] U.S. Cl. ..... 15/300 A; 15/353; 15/413

[58] Field of Search ..... 15/300 A, 321, 413; 55/470, 472; 415/60, 64, 66; 417/234, 247

[56] References Cited

U.S. PATENT DOCUMENTS

| | | | |
|---|---|---|---|
| 2,726,807 | 12/1955 | Lewis | 15/300 A X |
| 3,240,000 | 3/1966 | Hayes et al. | 15/300 A X |
| 3,331,090 | 7/1967 | Reiber et al. | 15/413 X |
| 3,848,290 | 11/1974 | Bates | 15/300 A X |
| 4,088,424 | 5/1978 | Hyatt et al. | 15/413 X |
| 4,114,231 | 9/1978 | Nauta | 15/413 |

*Primary Examiner*—Christopher K. Moore
*Attorney, Agent, or Firm*—Swabey, Mitchell, Houle, Marcoux and Sher

[57] ABSTRACT

A suction power unit for a wet vacuum machine includes a dome-shaped housing closed off by a bottom wall with an inlet defined in the bottom wall and a centrifugal blower aligned with the inlet. A second wall is parallel to the bottom wall and spaced therefrom defining an exhaust chamber about the centrifugal blower and hermetically separating the motor on the centrifugal blower from the exhaust chamber. An inlet opening in the second wall and a third wall spaced from the second wall and parallel thereto define a chamber, and a second centrifugal blower is provided in the so-formed chamber between the second and third walls with the motor beyond the third wall hermetically sealed from the chamber formed between the second and third walls. Exhaust ports communicate the chamber with the atmosphere such that an unimpeded flow is provided from the inlet and the bottom wall through the first centrifugal blower through the inlet in the second wall through the second centrifugal blower through the exit exhaust ports, and the air flow is completely isolated from the motors of the two centrifugal blowers.

6 Claims, 2 Drawing Figures

WET VACUUM MACHINE

BACKGROUND OF THE INVENTION

1. Field of the Invention

The present invention relates to vacuum cleaners and is particularly related to commercial so-called wet vacuum cleaners used in conjunction with washing fluids for cleaning carpets and the like, whereby a powerful suction is required to pick up the washing and rinsing fluids from the carpet.

2. Description of the Prior Art

Heretofore, numerous types of wet vacuum machines have been suggested which utilize a plurality of centrifugal blower fans arranged in series or in parallel with respect to the flow in order to increase the suction power of the machine. Examples of such vacuum machines are illustrated in U.S. Pat. No. 2,719,596, issued Oct. 4, 1955 to M. A. Kent et al; U.S. Pat. No. 3,219,262, issued Nov. 23, 1965 to S. I. Kronenberg; U.S. Pat. No. 3,240,000, issued Mar. 15, 1966, to R. S. Hayes et al; and U.S. Pat. No. 4,087,881, issued May 9, 1978, to Jack A Bates.

The problems faced by all such wet vacuum machines is that as the fluids are drawn into the reservoir by the air flow under suction, much liquid in atomized form will follow the air flow through the centrifugal blower fans. When the blower units are arranged in clusters, it is evident that the discharge of one unit may be blown onto the motor of the other and, of course, the high moisture content will be detrimental to the electrical components of the motor.

In certain of the above patents, attempts have been made to channel the air flow from a first blower to the intake of a second blower mounted in series by passing the air flow through a plurality of tubes bypassing the motor on the first blower. Such a construction is relatively expensive while impeding the flow of air, thereby reducing the effectiveness of the suction. Other baffle systems designed to protect the motor from the bypassed air flow reduce fresh air circulation to cool the motor.

SUMMARY OF THE INVENTION

It is an aim of the present invention to provide a multiple centrifugal blower system without the disadvantages mentioned above.

It is an aim of the present invention to provide an improved wet vacuum machine of simple construction within which the air flow under suction is passed from a first centrifugal blower to a second blower through an air path which is not restricted and which is completely isolated from the motors of the blower units.

A construction in accordance with the present invention comprises a suction power unit for use with a wet vacuum machine comprising a housing, a first electric motor-centrifugal fan arrangement located in the housing, inlet means communicating with the fan, an exhaust chamber defined at right angles to the centrifugal fan, means hermetically isolating the motor of said first centrifugal blower from said exhaust chamber, a second centrifugal blower arranged in said housing having an axis of rotation parallel to but spaced from the axis of rotation of said first centrifugal blower, an inlet means communicating the first exhaust chamber with the fan of said second centrifugal blower, and a second exhaust chamber formed at right angles to the axis of the second blower, and means hermetically isolating the motor of the second centrifugal blower from the second exhaust chamber and exhaust ports communicating with said second exhaust chamber.

Another aspect of the present invention comprises a wet vacuum apparatus including a housing, a suction system within said housing, the housing including a first closed wall and a second partition wall spaced from the first wall inwardly of the housing and parallel to the first wall, a third partition wall perpendicular to the second wall, and a fourth partition wall spaced from the second wall inwardly of the housing and parallel to the second wall and forming a closed chamber with said second and third walls and the wall of the housing, the first wall defining an air inlet, a first centrifugal blower unit mounted to the second wall such that the blower fan is between the first and second walls with the air inlet aligned with the axis of rotation of the fan, and with the electric motor of said centrifugal blower located on the opposite side of said second wall to the first wall such that the motor is isolated from the air passage formed between the first and second walls, an air inlet opening formed in said second wall spaced from the first centrifugal blower, a second centrifugal blower unit mounted to the fourth wall such that the blower fan is located in said chamber between the second and fourth walls and the axis of rotation is aligned with the inlet opening in the second wall, the motor of the second centrifugal blower located on the opposite side of the fourth wall from the second wall such that it is hermetically isolated from the air passage in said chamber, and exhaust ports in the housing wall communicating the chamber with the atmosphere.

In a more specific embodiment of the present invention, an air filter of cylindrical construction is provided surrounding the inlet defined in the first wall in the housing so that the air passing from the reservoir unit to the blower is passed through the filter unit.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 2:
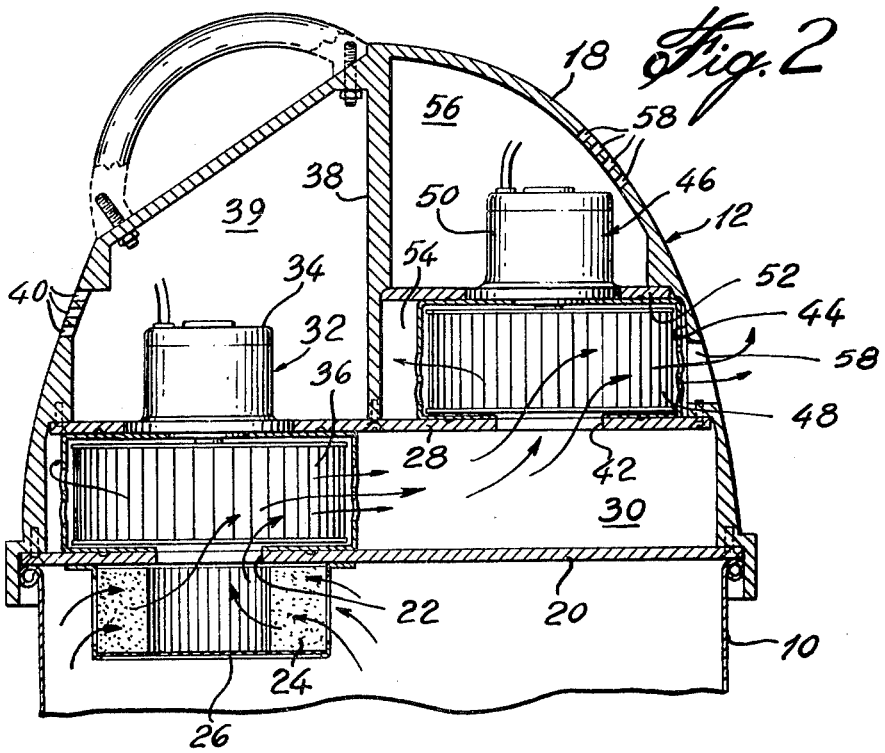
FIG. 2 is a vertical cross-section taken through the housing of the suction power unit of the wet vacuum machine.
Figure 1:
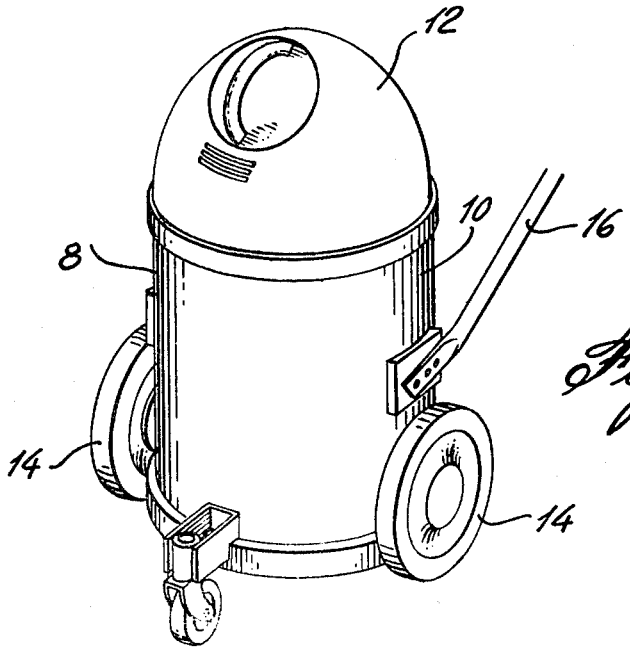
FIG. 1 is a perspective view of a typical wet vacuum machine incorporating the present invention.

As is well known in the industry, wet vacuum machines include a first reservoir 10 into which the liquid can be drawn and a suction power unit 12 which creates the suction drawing the air and liquid into the wet vacuum. The wet vacuum machine 8 includes, in the present embodiment, wheels 14 and a typical handle 16.

Referring to the cross-sectional view in FIG. 2, the housing 12 is somewhat dome-shaped and is completely enclosed by the housing wall 18. A first wall 20 separates the housing 12 from the reservoir 10. The wall 20 is provided with an opening 22, and a cylindrical filter member 24 surrounds the opening 22. The cylindrical filter 24 in this case is a conventional air filter for automobiles. The bottom of the filter is closed off by a plate 26. It is evident that the filter 24 can be replaced at will and is meant to collect dirt in the air and also to prevent foam from entering too readily into the blower unit.

A second wall 28 is spaced from the first wall 20 within the housing unit and defines a chamber 30 surrounding the centrifugal blower 32. The centrifugal blower 32 includes a motor 34 and a centrifugal fan 36. The fan 36 is the only part of the centrifugal blower 32 which is within the chamber 30. The motor 34 is fixed to the wall 28, but on the opposite side thereof, and is completely sealed from the chamber 30. A wall 38 defines a chamber surrounding the motor 34, and vent ports 40 are provided for allowing circulating air to enter into the chamber 39. The motor housing of motor 34 may be provided with a small fan for enhancing the air circulation. It can be seen that the chamber 39 is hermetically sealed from the chamber 30 and, therefore, air flow passing through the blower section 36 does not enter into the chamber 39 and thus the motor 34 is completely isolated from the humidity in the air passing through the chamber 30. Also defined in the wall 28 is an inlet opening 42 which communicates chamber 30 with chamber 44 in which the centrifugal blower 46 is provided. The blower 46 includes the blower section 48 and the motor 50. A wall 52 separates the chamber 54 from the motor chamber 56. The motor 50 is provided within the chamber 56 defined by the walls 38 and 52 as well as the wall of the housing 18. Again, vent ports 58 are provided for allowing circulating air to enter into the motor chamber 56. Exhaust ports 58 are defined in the wall 18 of the housing 12 to allow the air to exhaust from the chamber 54. In a more powerful unit, more centrifugal blowers can be provided following the sequential and stepped arrangement described above.

In operation, the air flow and moisture enters into the reservoir and the liquid carried by the air flow is deposited in the reservoir 10 while the remaining air and remaining moisture continue through the filter 24 through the inlet port 22 and are exhausted by the centrifugal fan 36 into the chamber 30. The chamber 30 is quite large, relatively speaking, and is unimpeded. The air being exhausted into the chamber 30 passes through the only exhaust opening which is the inlet opening 42 communicating with the centrifugal fan section 44 of the centrifugal blower 46. A chamber 54 surrounds the centrifugal blower section 48, and the exhaust of the blower section 48 and the chamber 54 passes through the exit ports 58 to the atmosphere.

The construction described is an improvement in simplicity as well as efficiency with respect to increased suction power when using clusters or at least a pair of centrifugal blowers in series. It can be seen that the exhaust from the first blower 32 is unimpeded since it enters into the large chamber 30 and thence to the blower 46. The arrangement of the blowers, of course, prevents moisture from entering into the motors 34 and 50.

I claim:

1. A suction power unit for use with a wet vacuum machine comprising a housing, a first electric motor-centrifugal fan arrangement provided in the housing, the first centrifugal fan having an axis of rotation, inlet means communicating axially with the fan, an exhaust chamber defined radially of the centrifugal fan, means hermetically isolating the motor of said first centrifugal fan from said exhaust chamber, the exhaust chamber being defined by walls of the housing including a top wall in a plane at right angles to the axis of the first centrifugal fan, an inlet aperture defined in the top wall of the exhaust chamber, a second centrifugal fan arranged in said housing having an axis of rotation parallel to but spaced from the axis of rotation of the first centrifugal fan, the inlet aperture communicating axially with the second centrifugal fan, a second exhaust chamber formed radially of the second centrifugal fan, and means hermetically isolating the motor of the second centrifugal fan from the second exhaust chamber, and exhaust ports communicating said second chamber with the atmosphere.

2. An apparatus as defined in claim 1, wherein the motor of the first centrifugal fan is located in a circulation chamber defined by the housing and hermetically isolated from the exhaust chamber of the first centrifugal fan and the motor of the second centrifugal fan is provided in a separate circulating chamber defined by the housing and hermetically isolated from the exhaust chamber of the second centrifugal fan.

3. A wet vacuum apparatus including a housing, a suction system within said housing, the housing including a first closed wall and a second partition wall spaced from the first wall inwardly of the housing and parallel to the first wall, a third partition wall perpendicular to the second wall, and a fourth partition wall spaced from the second wall inwardly of the housing and parallel to the second wall and forming a closed chamber with said second and third walls and the wall of the housing, the first wall defining an air inlet, a first centrifugal blower unit having a first centrifugal blowing fan mounted to the second wall such that the blower fan is between the first and second walls with the air inlet aligned with the axis of rotation of the fan and with the electric motor of said centrifugal blower located on the opposite side of said second wall to the first wall such that the motor is isolated from the air passage formed between the first and second walls, an air inlet opening formed in said second wall spaced from the first centrifugal blower unit, a second centrifugal blower unit having a second centrifugal blower fan mounted to the fourth wall such that the second blower fan is located in said chamber between the second and fourth walls, and the axis of rotation is aligned with the inlet opening in the second wall, the motor of the second centrifugal blower unit located on the opposite side of the fourth wall from the second wall such that it is hermetically isolated from the air passage formed between the first and second walls and exhaust ports provided in the housing wall communicating the chamber between the second and fourth walls with the atmosphere.

4. An apparatus as defined in claim 3, wherein an air filter surrounds the first inlet opening in the first closed wall and air flow passing through the inlet passes first through the air filter.

5. An apparatus as defined in claim 4, wherein the second and third walls defining with the housing a circulating chamber surrounding the motor of the first centrifugal blower and a series of venting ports being provided in the housing wall communicating with the circulating chamber of the first motor, said circulating chamber being hermetically isolated from the exhaust chamber formed between the first and second walls and the exhaust chamber formed between the second, third and fourth walls, the third and fourth walls and the wall of the housing defining a second circulating chamber surrounding the motor of the second centrifugal blower and venting ports are provided in the housing wall communicating the second circulating chamber with the atmosphere to allow circulating air to pass through the chamber, said second circulating chamber being hermetically isolated from the other chambers.

6. An apparatus as defined in claim 4, wherein the axis of rotation of the first centrifugal blower is spaced from the axis of rotation of the second centrifugal blower and the second centrifugal blower is stepped such that the central inlet of the fan of the second centrifugal blower is higher relatively in the housing than the centrifugal fan of the first centrifugal blower.

* * * * *